US007780498B1

(12) United States Patent
Caspi et al.

(10) Patent No.: US 7,780,498 B1
(45) Date of Patent: Aug. 24, 2010

(54) REMOTE CONTROL AIRCRAFT WITH PARACHUTES

(75) Inventors: Yuval Caspi, Granada Hills, CA (US); Chung Ming Leung, Dong Guan (CN)

(73) Assignee: MGA Entertainment, Inc., Van Nuys, CA (US)

( * ) Notice: Subject to any disclaimer, the term of this patent is extended or adjusted under 35 U.S.C. 154(b) by 1007 days.

(21) Appl. No.: 11/420,209

(22) Filed: May 24, 2006
(Under 37 CFR 1.47)

Related U.S. Application Data

(60) Provisional application No. 60/683,942, filed on May 24, 2005.

(51) Int. Cl.
*A63H 33/20* (2006.01)
*A63H 27/00* (2006.01)

(52) U.S. Cl. ..... 446/51; 446/57; 446/454

(58) Field of Classification Search ..... 446/49–51, 446/56–58, 454; 244/2, 190, 137.3, 139, 244/153 R, 155 R
See application file for complete search history.

(56) References Cited

U.S. PATENT DOCUMENTS

| | | | | |
|---|---|---|---|---|
| 1,925,768 | A * | 9/1933 | Mayo | 244/2 |
| 3,516,624 | A * | 6/1970 | Crook | 244/2 |
| 3,796,398 | A * | 3/1974 | Eilertson | 244/139 |
| 3,957,230 | A * | 5/1976 | Boucher et al. | 244/53 R |
| 4,208,949 | A * | 6/1980 | Boilsen | 89/1.801 |
| 4,256,012 | A * | 3/1981 | Cowart et al. | 89/1.816 |
| 7,377,832 | B2 * | 5/2008 | Chamberlain | 446/57 |

* cited by examiner

*Primary Examiner*—Kien T Nguyen
(74) *Attorney, Agent, or Firm*—Intellectual Property Law Offices of Joel Voelzke, APC

(57) ABSTRACT

A remote controlled aircraft may include a deployable main parachute, deployable paratroopers stored in the coils of helical spring actuator and moved into deployment position by rotation of the actuator. The actuator may be operated within a storage compartment configured to fit the actuator and to maintain alignment of the paratroopers before deployment. The remote control may include individual engine boost buttons and selectable, preprogrammed engine speeds. A secondary remote controlled aircraft may also be mounted for deployment on the main aircraft. Various configurations and combinations of elements and features are disclosed and may be claimed.

13 Claims, 4 Drawing Sheets

REMOTE CONTROL AIRCRAFT WITH PARACHUTES

RELATED APPLICATIONS

This patent application claims the priority of U.S. provisional patent application Ser. No. 60/683,942 filed on May 24, 2005.

BACKGROUND OF THE INVENTION

1. Field of the Invention

This invention is related to remote controlled aircraft.

2. Description of the Prior Art

Conventional remote controlled aircraft are limited in their abilities to provide functions in addition to flying.

What is needed is an configuration that provides enhanced functions.

SUMMARY OF THE INVENTION

A remotely controlled toy aircraft may include an aircraft body with remotely controlled flight surfaces and an interior space having a bottom opening through the aircraft body, one or more remotely controlled engines for causing the aircraft body to fly, a plurality of deployable units such as parachutists in the interior space, a rotatable lever, which may be helical, for selectively positioning one or more of the deployable units for deployment through the bottom opening and a remotely controllable electric motor for rotating the lever to deploy the units.

DETAILED DISCLOSURE OF THE PREFERRED EMBODIMENT(S)

Figure 1:
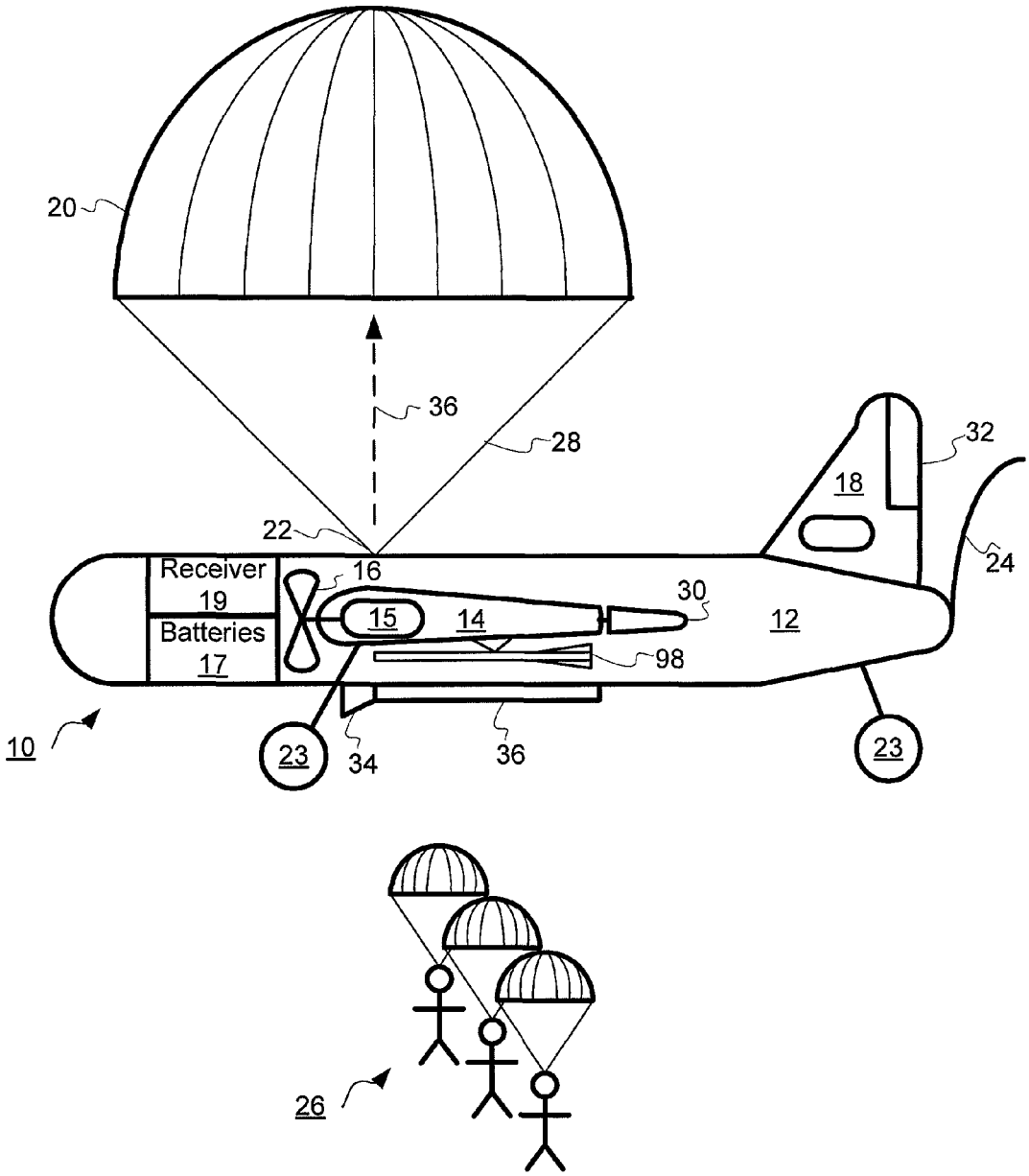
FIG. 1 is a side view of a stylized remote control aircraft 10 illustrating the deployment of paratroopers and an aircraft recovery parachute.

Referring now to FIG. 1, twin engine remote control aircraft 10 is shown in side view including fuselage 12, wing 14, engine driven propeller 16 and tail and rudder assembly 18. Main parachute 20 is shown deployed from the upper portion of fuselage 12. Point of attachment 22 at which chute 20 is secured to fuselage 12 determines the attitude of aircraft 10 as it descends back to earth under chute 20. The engines of a remote control aircraft are typically relatively much heavier than remaining portions of the aircraft. Point of attachment 22 between chute 20 and fuselage 12 may be substantially forward along fuselage 12 in order to be positioned above the center of gravity or the center of vertical rotation of aircraft 10. This permits aircraft 10 to land right side up on landing gear 23 even when landing with chute 20 deployed in order to avoid unnecessary damage. Propellers 16 may be driven by electrical motors 15, powered by batteries 17. The location of batteries 17 may be adjusted to control the weight and balance of aircraft 10.

Chute 20 may be deployed at any time by remote control in accordance with signals received, processed and distributed within aircraft 10 via remote control receiver 19 and antenna 24. Antenna 24 may preferably be positioned at the tail of aircraft as shown or at other locations which are not likely to cause interference with aircraft operations such as the deployment of main chute 20 described above or of one or more paratroopers 26 described below in greater detail. Receiver 19 may preferably be located at the forward end of aircraft 10. Depending on the application, it may be advantageous to automatically control the operation of engine driven propellers 16 in response to deployment of chute 20. One simple expedient may be to stop operation of engine driven propellers 16 upon deployment of chute 20 in order to avoid interference between chute 20 and its supporting guy lines 28.

In a preferred embodiment, however, the operation of engine driven propellers 16 may be reduced to a slow speed, not sufficient for aircraft 10 to gain altitude, but sufficient to provide steerage of aircraft via remote control. For example, both engine driven propellers may be operated to provide aircraft flight speed at which normal remotely controlled flight surfaces, such as ailerons 30 or movable rudder assembly 32, remain able to control the direction of travel of aircraft 10 by controlling roll and/or pitch and yaw. Alternately, the engine driven propellers 16 at each side of aircraft 10 may be operated at different speeds to control the direction of flight. These modes of control during deployment of main chute 20 may be automatically combined by, for example, causing both engine driven propellers 16 to operate at a low speed to provide some control of the stability of aircraft 10 while descending under chute 20 while providing the operator with the ability to add a fixed or variable amount of additional speed to either propeller 16 to force aircraft 10 into a different direction of flight.

Deployment of main chute 20 may preferably be aided by air directed by aircraft 10 into chute 20 to cause chute 20 to fill with air. Air scoop 34 may be positioned in an airflow path, such as beneath fuselage 12, to collect air and force it via ducting to follow air flow path 36, filling chute 20 as will be described below in more detail with reference to FIG. 2. Spring 39, also shown in FIG. 2 may be used for deployment of chute 20.

One or more paratroopers 26, in the form of small weights or more lifelike doll figures with parachutes, may be remotely deployed from the underside or other portions of fuselage 10, for example from bomb-bay doors 36. To minimize the chances of unwanted entanglements, the paratroopers may preferably be deployed from an opening in the bottom of fuselage 12 flush with aircraft 10.

Figure 2:
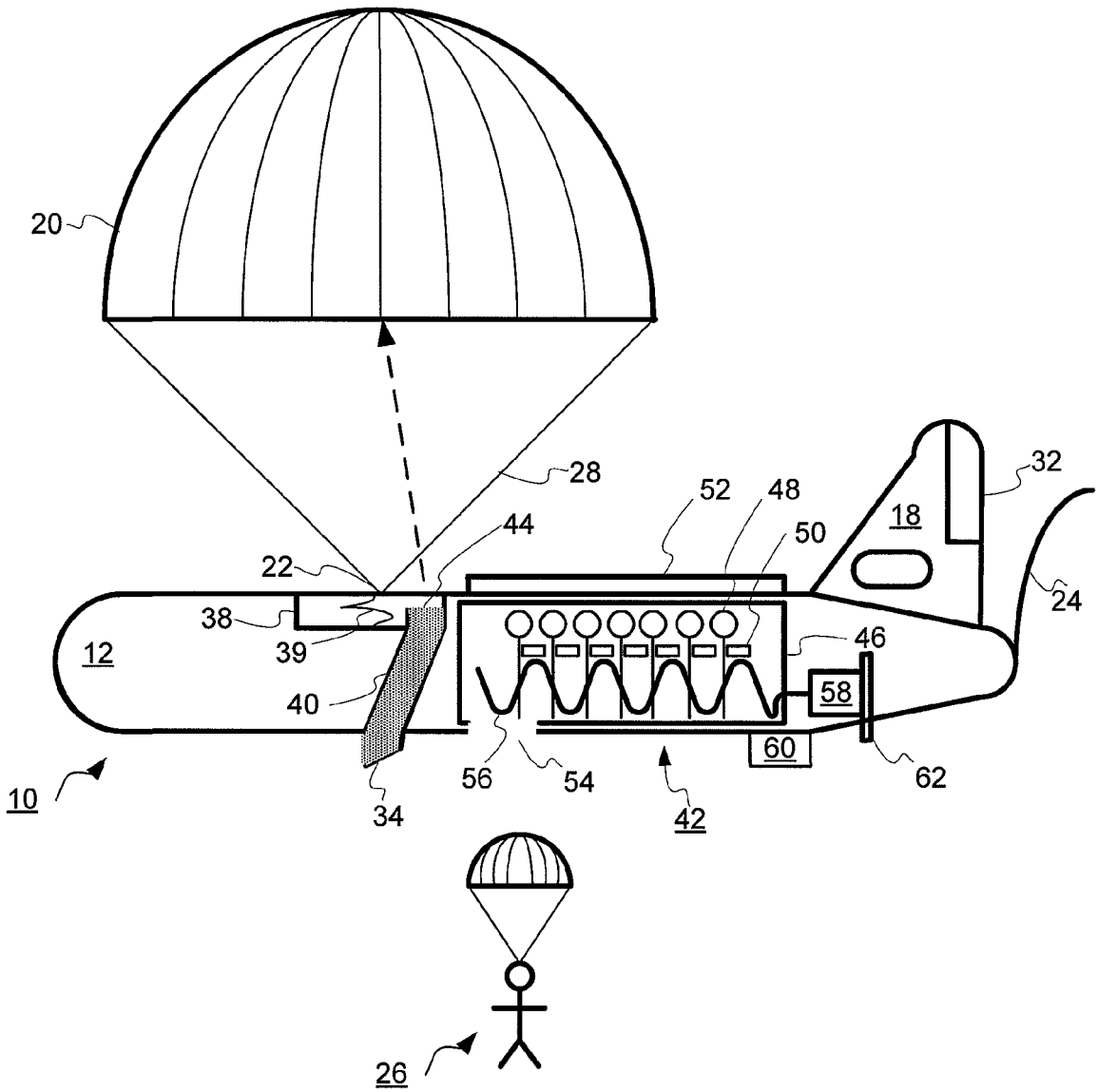
FIG. 2 is a side view of aircraft 10 in which mid portion on fuselage 12 is shown in cross section.

FIG. 2 is a side view of the aircraft of FIG. 1 in which a mid portion on fuselage 12 is shown in cross section exposing main chute storage compartment 38, including spring 39, in which main chute 20 is stored before deployment, air channel 40 used during deployment of main chute 20, and paratrooper storage and deployment compartment 42.

Main chute storage compartment 38 is used for storing main chute 20, before deployment, and is preferably located at or near connection point 22 to which shrouds 28 of chute are connected while chute 20 is stored, deployed and in use. In accordance with main chute deployment remote control signals received by antenna 24 and processed by receiver 19, a hatch or other release mechanism is employed to permit main chute 20 to be released from storage for deployment by spring 39. Deployment is aided by air in air channel 40 which is under pressure from air entering scoop 34 during flight. The air in channel 40 is pushed upward from fuselage 12 via nozzle 44 which is preferably positioned on the upper surface of fuselage 12 at or aft of connection point 22. The air from channel 20 aids in the deployment and opening of chute 20 and may be directed towards the center of opening of chute 20 by the placement and/or direction of air flow through aperture 44. Aftward placement of nozzle 44 may be desirable because the forward motion of aircraft 10 through the air causes chute 20 to move aftwards relative to compartment 38 during deployment. When fully deployed, chute 20 may end up in a more forward location relative to compartment 38, typically directly above connection point 22.

Paratrooper storage and deployment compartment 42 includes storage compartment 46 in which a plurality of paratroopers 48, shown in side view with undeployed parachutes 50, are stored. Paratroopers 48 may be positioned in compartment 46 via opening hatch 52 located on the top or bottom surface of fuselage 12 or via paratrooper deployment aperture 54 which may be an opening through bomb-bay doors 36, shown in FIG. 1, or simply an opening through the bottom surface of fuselage 12 communicating with an opening in one end of compartment 46. Paratroopers 48 are positioned in compartment 46 within the turns of actuator 56 which is preferably a helical spring shaped metal or plastic rod, mounted for rotation along an axis by motor 58.

As shown in FIG. 2, motor 58 may be positioned aft of compartment 46 so that rotation of actuator 56 causes paratroopers 48 to move forward in a generally linear direction along a long axis of fuselage 12 until reaching a location above paratrooper deployment aperture 54 at the forward end of compartment 46. Loading of paratroopers 48 may be accomplished by insertion of each paratrooper 46 through aperture 54 coupled with rotation of actuator 56 by motor 58 in the opposite direction, i.e. aftwards, from the direction used to deploy paratroopers 48. The rotation of actuator 56 may be accomplished in accordance with remote loading signals received by antenna 26 or by actuation of loading button 60 which may be located on aircraft 10 and connected to motor 58. Alternately, thumbwheel 62 may be mounted for rotation of motor 58 and extend through fuselage 12 to provide access for manual rotation of actuator 56 in either direction to load, deploy or correct a jam or other problems with paratroopers 48 in compartment 46.

Deployment aperture 54 is shown in FIG. 2 positioned at the forward end of compartment 46 opposite motor 58. Aperture 54 may also be located at the aft end of compartment 46 adjacent motor 58 requiring rotation of motor 58 in the opposite direction than that used in the configuration shown in FIG. 2. A pair of apertures 54 may be used, one at each end of compartment 56 so that rotation of actuator 56 in one direction supports both loading and deployment of paratroopers 48. Alternatively, motor 58 can be positioned forward of compartment 46 and used with one or two apertures 54 as described above. The location of motor 58 may be used to alter the weight and balance aspects of aircraft 10 both for flight as well as for descent under main chute 20. It may be preferable to position motor 58 at the rear of compartment 46, furthest away from the center of mass of engine driven propellers 16, in order to control the center of gravity of aircraft 10 so that connection point 22 may be positioned in a convenient location while preserving a generally horizontal attitude of aircraft 10 during descent to prevent damage.

When rotation of motor 58 from paratrooper deployment signals received by antenna 24 and processed by receiver 19 causes actuator 56 to position one of the paratroopers 48 above deployment aperture 54, gravity causes that paratrooper to fall through aperture 54 after which folded parachute 50 is automatically deployed as shown, for example, by paratrooper 26.

Figure 3:
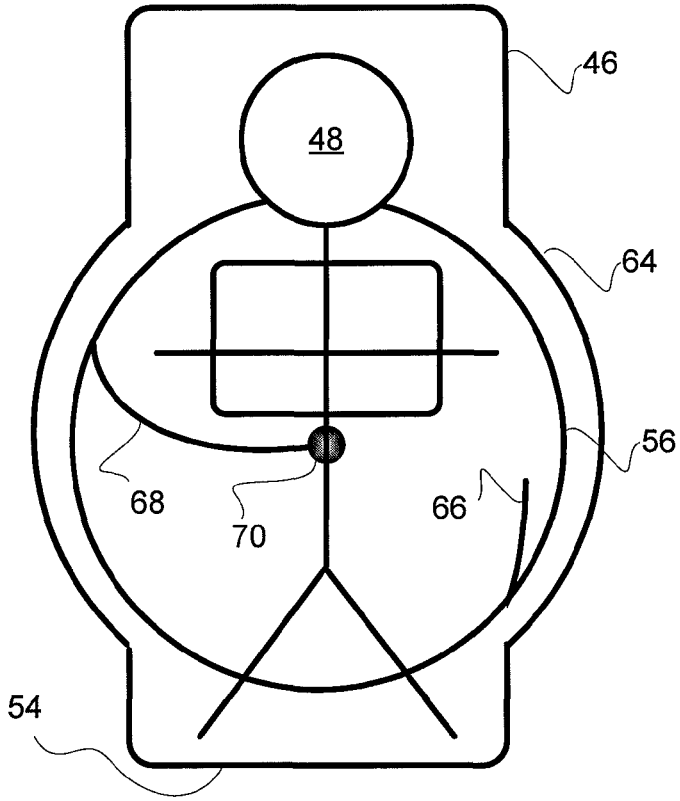
FIG. 3 is an enlarged cross sectional end view of compartment 46 including paratrooper 48 positioned in one coil of helical actuator 56.

Referring now to FIG. 3, an enlarged cross sectional end view of compartment 46 is shown including paratrooper 48 positioned in one coil of helical actuator 56. Compartment 46 is taller than paratrooper 48 and as wide as helical actuator 56 at least in the portion of compartment 46 where actuator 56 is located. In particular, compartment 46 has a cylindrical bulge 64 centered about axis 70 of actuator 56. Leading end 66 is the most forward portion of actuator 56. Aft end 68 of actuator 56 is connected for rotation about axis 70 by motor 58. The most forward paratrooper 48 may be positioned in one of the first coils of helical actuator 56. As shown in FIG. 3, rotation of motor 58 about axis 70 has caused the most forward paratrooper 56 to be positioned just behind leading end 66, over aperture 54, so that paratrooper 48 will begin to drop for deployment.

Continued rotation of actuator 56 will cause each paratrooper 48, within a coil of the actuator to be moved along axis 70 toward aperture 54 for deployment. Actuator 56 is preferably a helical spring rotated about an axis 70 within a coaxial cavity 46 to provide linear motion for a deployable package, such as paratroopers, bombs, confetti and the like to move the deployable package from a storage position to a deployment position by continuous rotation. In this manner, remote operation of a rotating motor can directly and simply be translated into motion along a line to move each of a plurality of stored deployable packages into a deployment position without the need for complex mechanics.

Figure 4:
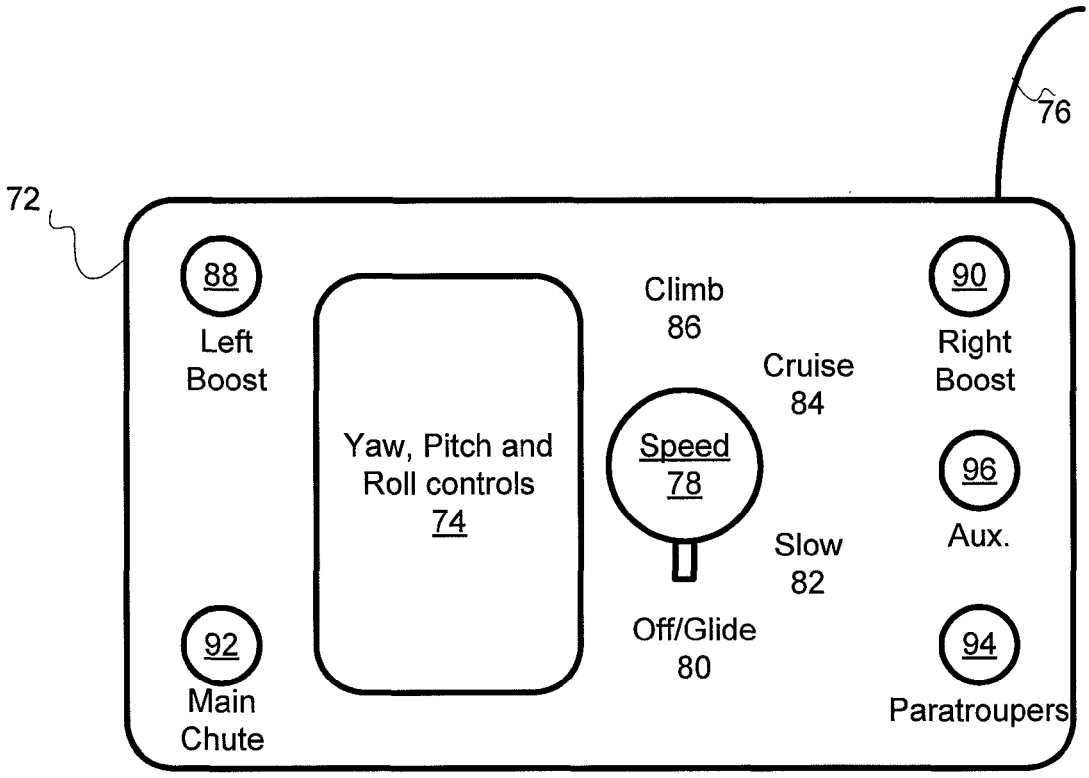
FIG. 4 is a top view of remote control 72.

Referring now to FIG. 4, remote control 72 includes conventional remote aircraft controls 74 for controlling yaw, pitch and roll which may be configured in many different ways, together with transmitting antenna 76 for communicating signals resulting from operation of those controls to receiving antenna 24 of aircraft 10 as described above. In addition, control 72 may include engine speed control 78 with preset speed selections 80, 82, 84 and 86. Engine off speed selection 80, in addition to normal uses such as turning the engine driven propellers off when not flying aircraft 10, may be useful during a descent when main chute 20 has been deployed. Slow speed selection 82 may be convenient both for landing and also for maneuvering aircraft 10 during deployment of paratroopers 26 over a target zone as well as maneuvering during descent under main chute 20. Cruise speed selection 86 may be useful for climbing under a full load, for example of paratroopers 48, as well as high speed level flight.

Speed selections 80, 82, 84 and 86 may conveniently be factory preset or preprogrammed so that remote control operation of aircraft 10, with either or both main chute 20 and paratrooper 48 deployment, be as easy as possible for the operator and provide responses closely resembling the responses that would be expected from aircraft without such features. Preferably these speed selections are field programmable to permit the operator to customize performance of aircraft 10 as the operator becomes more familiar with its performance.

Additional speed controls may be provided including separate left and right engine boost buttons 88 and 90, respectively. Engine speed boost buttons 88 and 90 may be preprogrammed to operate differently in different flight configurations. For example, when speed selection control 78 is in off or glide position 80, operation of either boost button may be programmed to provide an increase in the speed of the associated propeller 16 to at or near the next higher speed selection, slow speed 82, to aid in flight direction control during a descent under main chute 20 or an engine out glide. For example, in order to conserve battery power particularly to perform landing operations when the battery has been almost completely discharged, speed selection 78 may be used to select off speed 80 so that battery drain is minimized. Limited flight controls, such as turning on final for landing, may be achieved with minimal battery usage by operation of conventional flight controls aided for quick turning by operation of one of the boost buttons.

Similarly, when speed selection 78 is used to select slow speed 82, operation of one or more of the boost buttons 88 and 90 may be programmed to cause the relevant propeller(s) 16 to be driven at the higher cruise speed 84. In the same manner, when speed selection 78 is used to select cruise speed 84, operation of one or more of the boost buttons 88 and 90 may be programmed to cause the relevant propeller(s) 16 to be driven at the higher climb speed 86 in order to cause aircraft 10 to turn more sharply than it could be caused to turn with conventional controls 74.

Referring now also to FIGS. 1 and 2, remote control panel 72 may further include main chute deployment button 92, paratrooper deployment button 94 and one or more auxiliary buttons 96. Operation of main chute button 92 would cause deployment of main chute 20 from storage compartment 38 and may also be preprogrammed to change speed selection to the off or slow speed selection as noted above. Further, to reduce drag, air scoop 34 may normally be in a retracted position and deployed automatically upon operation of button 92 in order to aid deployment of chute 20.

Operation of paratrooper button 94 may cause motor 58 to rotate in the appropriate direction to move paratroopers 48 in compartment 46 to be deployed automatically through aperture 54. Button 94 may be programmed to deploy a single paratrooper 48, all paratroopers 48 in compartment 46 or to deploy paratroopers continuously while activated. Bomb-bay doors 36, if present, may be automatically opened upon operation of button 94. Preferably, button 94 may be implemented as a double throw temporary contact switch, such as a rocker switch, so that in addition to the preprogrammed deployment of paratroopers by operating motor 58 in one direction, motor 58 may be operated in the opposite direction in order to clear a jam while aircraft 10 is flying.

Operation of the one or more auxiliary buttons 96 may be used to deploy other features such a foam darts 98 which may be mounted under the wings of aircraft 10.

Figure 5:
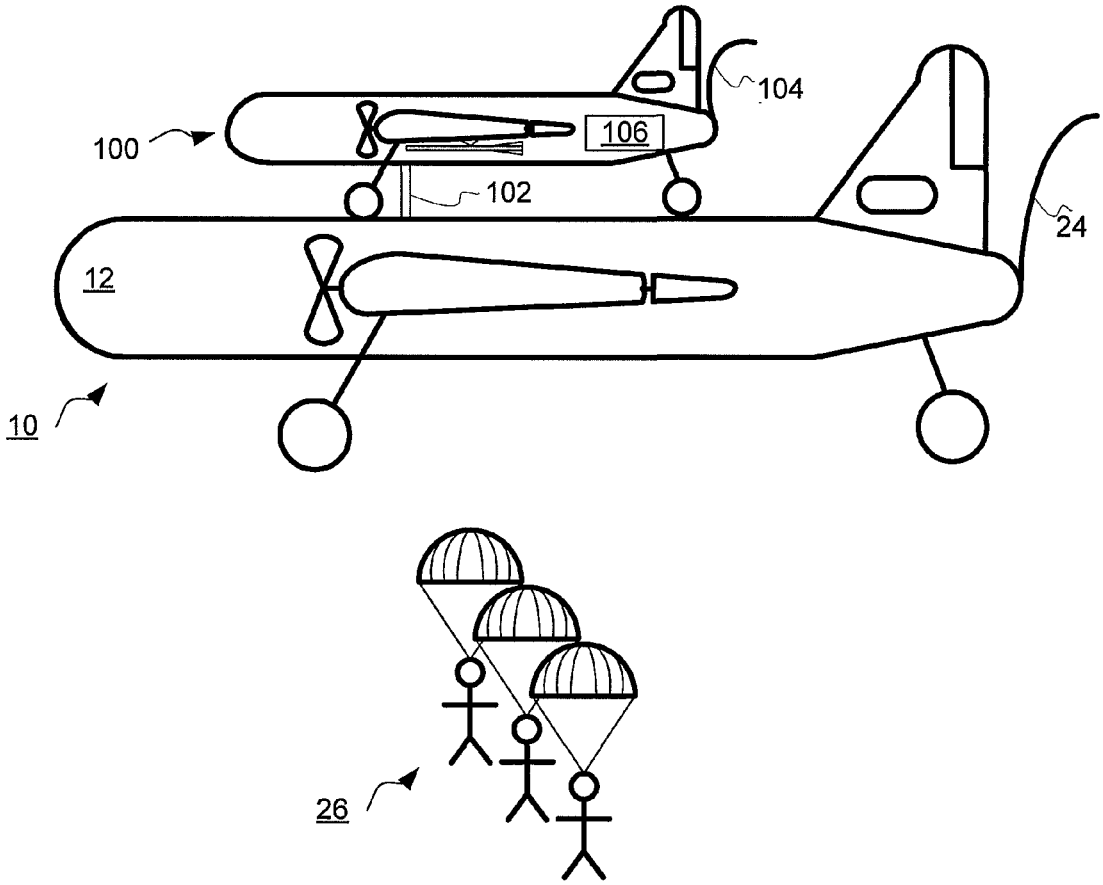
FIG. 5 is a side view of remotely launchable aircraft 100 mounted on aircraft 10.

Referring now to FIGS. 1 and 5, in a configuration without main chute 20, secondary aircraft 100 may be secured to the upper fuselage of aircraft 10 for remote controlled deployment by attachment arm 102 in response to operation of a button on remote control 76, shown in FIG. 4, such as button 92. Aircraft 100 may be a simple glider without remote control and operation of remote control 76 after deployment of aircraft 100 may continue to control the flight of aircraft 10. Alternatively, aircraft 100 may include receiver and antenna 104, together with battery 106 to control powered or unpowered operation of aircraft 100 after deployment while aircraft 10 is caused to operate automatically in a preprogrammed recovery mode, including by gliding and/or deployment of main chute 20. Preferably, deployment of main chute 10, aided by air flow as described above, may be used to aid in the launching and deployment of aircraft 100.

If aircraft 100 is intended for powered remote control operation after deployment, it may be advantageous for battery 106 to be used to power aircraft 10 before deployment of aircraft 100 to minimize the total weight of the combined aircraft. Paratroopers 26 may also be deployed from aircraft 10 in the manner described above.

What is claimed is:

1. A remotely controlled toy aircraft, comprising:

an aircraft body with remotely controlled flight surfaces and an interior space having a bottom opening through the aircraft body;

at least one remotely controlled engine for causing the aircraft body to fly;

a plurality of deployable units in the interior space;

a rotatable lever for selectively positioning one or more of the deployable units for deployment through the bottom opening;

a remotely controlled electric motor for rotating the lever to deploy the units;

a parachute releasably towed in a second interior space having a top opening through the aircraft body; and an air scoop intake for channeling air, moving past the aircraft body during flight, into the parachute to aid in deployment of the parachute.

2. The invention of claim 1 wherein the aircraft further comprises:

a spring mechanism associated with the second interior space for deploying the parachute.

3. A remotely controlled toy aircraft, comprising:

an aircraft body with remotely controlled flight surfaces and an interior space having a bottom opening through the aircraft body;

at least one remotely controlled engine for causing the aircraft body to fly;

a plurality of deployable units in the interior space;

a rotatable lever for selectively positioning one or more of the deployable units for deployment through the bottom opening;

a remotely controlled electric motor for rotating the lever to deploy the units; and a manually operable wheel for rotating the rotatable lever to position the rotatable units within the interior space.

4. The invention of claim 1 or 3 wherein the bottom opening is located in an aft portion of the interior space.

5. The invention of claim 1 or 3 wherein the interior space has a height sufficient to allow motion of the deployable units and a width with a bulge sufficient to permit rotation of the rotatable lever.

6. The invention of claim 1 further comprising:

a remote controller for automatically reducing the speed of the one or more remotely controlled engines upon deployment of the parachute.

7. The invention of claim 1 or 3 further comprising:

a remote controller for changing the speed of one of the one or more remotely controlled engines compared to another of the one or more remotely controlled engines to control the direction of flight of the remotely controlled toy aircraft.

8. The invention of claim 1 or 3 further comprising:

a manually opening hatch on the top of the aircraft providing access to the interior space of the deployable units therein.

9. The invention of claim 8 further comprising:

a remote controller for automatically reducing the speed of the one or more remotely controlled engines upon release of the second toy aircraft.

10. The invention of claims 1 or 3 further comprising:

a second toy aircraft releasably mounted on top of the toy aircraft.

11. The invention of claim 1 further comprising:

a second toy aircraft releasably mounted on top of the toy aircraft, and a remote controller for automatically releasing the parachute upon release of the second toy aircraft.

12. The invention of claim 1 or 3 wherein the rotatable lever further comprises:

a generally helical shaped portion for moving deployable units in the interior space to a position for deployment through the bottom opening.

13. A remotely controlled toy aircraft, comprising:

a line of toy parachutists;

an aircraft body with remotely controlled flight surfaces and an interior space in a fuselage section high enough to house the line of toy parachutists, the interior space having a bottom opening through the aircraft body;

a rotatable helical element wider than a width of the line of toy parachutists for moving the line of toy parachutists toward a deployment position for each parachutists adjacent the bottom opening, the interior space having a generally central bulge wide enough to permit rotation of the helical element while maintaining the line of toy parachutists; and a remotely controllable electric motor for rotating the helical element to deploy the units.

* * * * *